US012623883B1

(12) United States Patent
Jackson et al.

(10) Patent No.: US 12,623,883 B1
(45) Date of Patent: May 12, 2026

(54) LIGHT ROLLER DEVICE

(71) Applicants: David Terry Jackson, Marlton, NJ (US); Debra Yvonne Jackson, Marlton, NJ (US); Laura Debra Jackson, Marlton, NJ (US)

(72) Inventors: David Terry Jackson, Marlton, NJ (US); Debra Yvonne Jackson, Marlton, NJ (US); Laura Debra Jackson, Marlton, NJ (US)

( * ) Notice: Subject to any disclaimer, the term of this patent is extended or adjusted under 35 U.S.C. 154(b) by 74 days.

(21) Appl. No.: 18/440,853

(22) Filed: Feb. 13, 2024

Related U.S. Application Data

(60) Provisional application No. 63/445,102, filed on Feb. 13, 2023.

(51) Int. Cl.
*B65H 75/44* (2006.01)
*B65H 75/40* (2006.01)

(52) U.S. Cl.
CPC ..... *B65H 75/4402* (2013.01); *B65H 75/406* (2013.01); *B65H 2404/13171* (2013.01); *B65H 2701/3915* (2013.01)

(58) Field of Classification Search
CPC ... B65H 75/44; B65H 75/406; B65H 75/4402
See application file for complete search history.

(56) References Cited

U.S. PATENT DOCUMENTS

| | | | | |
|---|---|---|---|---|
| 5,868,334 | A * | 2/1999 | Cedillo | B65H 75/406 242/571.5 |
| 6,676,069 | B1 * | 1/2004 | Davis | B65H 75/146 242/608.5 |
| 6,902,130 | B1 * | 6/2005 | Salem | B65H 75/40 242/395 |
| 2004/0065764 | A1 * | 4/2004 | Rosaen | B65H 75/406 242/395 |
| 2006/0186253 | A1 * | 8/2006 | Smith | F21S 4/10 242/395 |

* cited by examiner

*Primary Examiner* — Sang K Kim
(74) *Attorney, Agent, or Firm* — The Law Office of Patrick F. O'Reilly III, LLC

(57) ABSTRACT

A light roller device is disclosed herein. The light roller device includes a support frame member; and a roller assembly coupled to the support frame member, the roller assembly including a roller member that is rotatable about a portion of the support frame member, the roller member configured to guide and/or support a wiring portion of a light strand as the light strand is being hung from an elevated object, and the roller member being inwardly tapered toward a middle portion of the roller member for guiding the wiring portion of the light strand to the middle portion of the roller member as the light strand is being hung from the elevated object.

19 Claims, 14 Drawing Sheets

LIGHT ROLLER DEVICE

CROSS-REFERENCE TO RELATED APPLICATIONS

This patent application claims priority to, and incorporates by reference in its entirety, U.S. Provisional Patent Application No. 63/445,102, entitled "Light Roller", filed on Feb. 13, 2023.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a light roller device. More particularly, the invention relates to a light roller device for facilitating the hanging of string lights on trees or any elevated structure.

2. Background

Many homeowners celebrate holidays, such as Christmas, by hanging decorative lighting on trees and/or the home. In some cases, the higher the lights are hanging, the better they look. Often, people use ladders and extension poles to get that extra elevated result, and sometimes attach various homemade tools to the end of extension poles. Some individuals hold a section of the lights as they lift them into place. Then, they release the lighting and move around a tree to grab another section and repeat this process. For such a procedure, the light installer needs great hand eye coordination to re-grab the light string because it always sways and moves. Add wind, rain or snow to the elements and the job becomes even more difficult. This procedure can be repeated until the whole string of lights is hanging.

A tool, such as a Y-shaped golf ball retriever, can make the above-described process somewhat easier by grabbing the string lights, but such a device does not help with the issue of needing to release the light string and then having to re-grab it again. As the re-grabbing of the light string is a difficult part of the light hanging task, a better solution is needed.

Even decorating one tree is a very time-consuming task, and taking down the lights is just as big a task. Using ladders or climbing the structure increases risks of falls, and is a potential safety issue. As such, a better solution is needed for solving the above-described problems.

Therefore, what is needed is a light roller device that can overcome one or more of these aforementioned problems encountered when hanging a strand of lights.

BRIEF SUMMARY OF EMBODIMENTS OF THE INVENTION

Accordingly, the present invention is directed to a light roller device that substantially obviates one or more problems resulting from the limitations and deficiencies of the related art.

In accordance with one or more embodiments of the present invention, there is provided a light roller device that comprises a support frame member; and a roller assembly coupled to the support frame member, the roller assembly including a roller member that is rotatable about a portion of the support frame member, the roller member configured to guide and/or support a wiring portion of a light strand as the light strand is being hung from an elevated object, and the roller member being inwardly tapered toward a middle portion of the roller member for guiding the wiring portion of the light strand to the middle portion of the roller member as the light strand is being hung from the elevated object.

In a further embodiment of the present invention, the roller member of the roller assembly further comprises a first tapered wall component, a second tapered wall component, and a center core component coupling the first tapered wall component to the second tapered wall component, the center core component being formed from a first material, and the first tapered wall component and the second tapered wall component being formed from a second material, the first material being more compliant than the second material.

In yet a further embodiment, the roller member of the roller assembly further comprises at least one end cap, the at least one end cap being coupled to an outer end of one of the first tapered wall component and the second tapered wall component, and the at least one end cap increasing a structural rigidity of the roller member.

In still a further embodiment, the support frame member comprises a bent rod-shaped member, the bent rod-shaped member comprises at least one vertical rod portion and a horizontal rod portion, the horizontal rod portion of the bent rod-shaped member forming the portion of the support frame member about which the roller member is rotatable so as to define a rotational axis of the roller member.

In yet a further embodiment, the bent rod-shaped member further comprises a diagonal rod portion, and the at least one vertical rod portion comprises a first lower vertical rod portion and a second upper vertical rod portion, the diagonal rod portion being connected between the first lower vertical rod portion and the second upper vertical rod portion, and the second upper vertical rod portion being connected between the diagonal rod portion and the horizontal rod portion.

In still a further embodiment, the light roller device further comprises a handle adapter connected to a lower end of the first lower vertical rod portion, the handle adapter comprising a plurality of internal threads configured to threadingly engage with a plurality of external threads on an end of a pole member.

In yet a further embodiment, the light roller device further comprises a guide arm member coupled to the support frame member, the guide arm member extending above at least a portion of the roller member, the guide arm member configured to restrict a vertical movement of the wiring portion of the light strand so as to urge the wiring portion of the light strand towards the middle portion of the roller member.

In still a further embodiment, the guide arm member further comprises a plurality of spaced-apart protrusions disposed along an upper portion of the guide arm member, individual ones of the plurality of spaced-apart protrusions being spaced apart from one another by respective notches, the plurality of spaced-apart protrusions disposed along the upper portion of the guide arm member being configured to be used to manipulate the light strand after the light strand has been hung from the elevated object.

In yet a further embodiment, the guide arm member further comprises a hook member disposed on an outer end of the guide arm member, the hook member defining a hook member gap, the hook member configured to prevent the light strand from sliding off the outer end of the guide arm member, and the hook member configured to prevent light bulbs on the light strand from being pulled through the hook member gap.

In still a further embodiment, the light roller device further comprises a cylindrical base component being coupled to an outer end of the first tapered wall component, the cylindrical base component forming an end cap for the first tapered wall component, and the cylindrical base component coupling the guide arm member to the support frame member.

In yet a further embodiment, the support frame member comprises a bent rod-shaped member, the bent rod-shaped member comprises at least one vertical rod portion and a horizontal rod portion, the horizontal rod portion of the bent rod-shaped member forming the portion of the support frame member about which the roller member is rotatable so as to define a rotational axis of the roller member.

In still a further embodiment, the horizontal rod portion of the bent rod-shaped member comprises at least one annular clip recess formed in the horizontal rod portion, the at least one annular clip recess configured to receive a retainer clip for maintaining the roller member in a fixed location along a length of the horizontal rod portion.

In yet a further embodiment, the at least one vertical rod portion of the bent rod-shaped member comprises a first lower vertical rod portion and a second upper vertical rod portion, and the cylindrical base component comprises a longitudinal slot formed in an outer surface of the cylindrical base component, the longitudinal slot configured to receive at least a part of the second upper vertical rod portion of the bent rod-shaped member in the longitudinal slot.

In still a further embodiment, the light roller device further comprises an angled gusset member connected between the cylindrical base component and the guide arm member, the angled gusset member configured to prevent the wiring portion of the light strand from becoming wedged in a gap between the cylindrical base component and the first tapered wall component of the roller member.

In yet a further embodiment, the light roller device further comprises a handle adapter connected to a lower end of the support frame member, the handle adapter comprising a plurality of internal threads configured to threadingly engage with a plurality of external threads on an end of a pole member.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

An illustrative embodiment of a light roller device is seen generally at 10 in FIGS. 1-13. Initially, with reference to FIG. 1, the illustrative light roller device 10 generally comprises a support frame member 20; and a roller assembly 30 coupled to the support frame member 20, the roller assembly 30 including a roller member 34, 36, 38 that is rotatable about a portion of the support frame member 20, the roller member 34, 36, 38 configured to guide and/or support a wiring portion of a light strand (see e.g., FIG. 14) as the light strand is being hung from an elevated object, and the roller member 34, 36, 38 being inwardly tapered toward a middle portion of the roller member 34, 36, 38 (see e.g., FIG. 1) for guiding the wiring portion of the light strand to the middle portion of the roller member 34, 36, 38 as the light strand is being hung from the elevated object.

Figure 1:
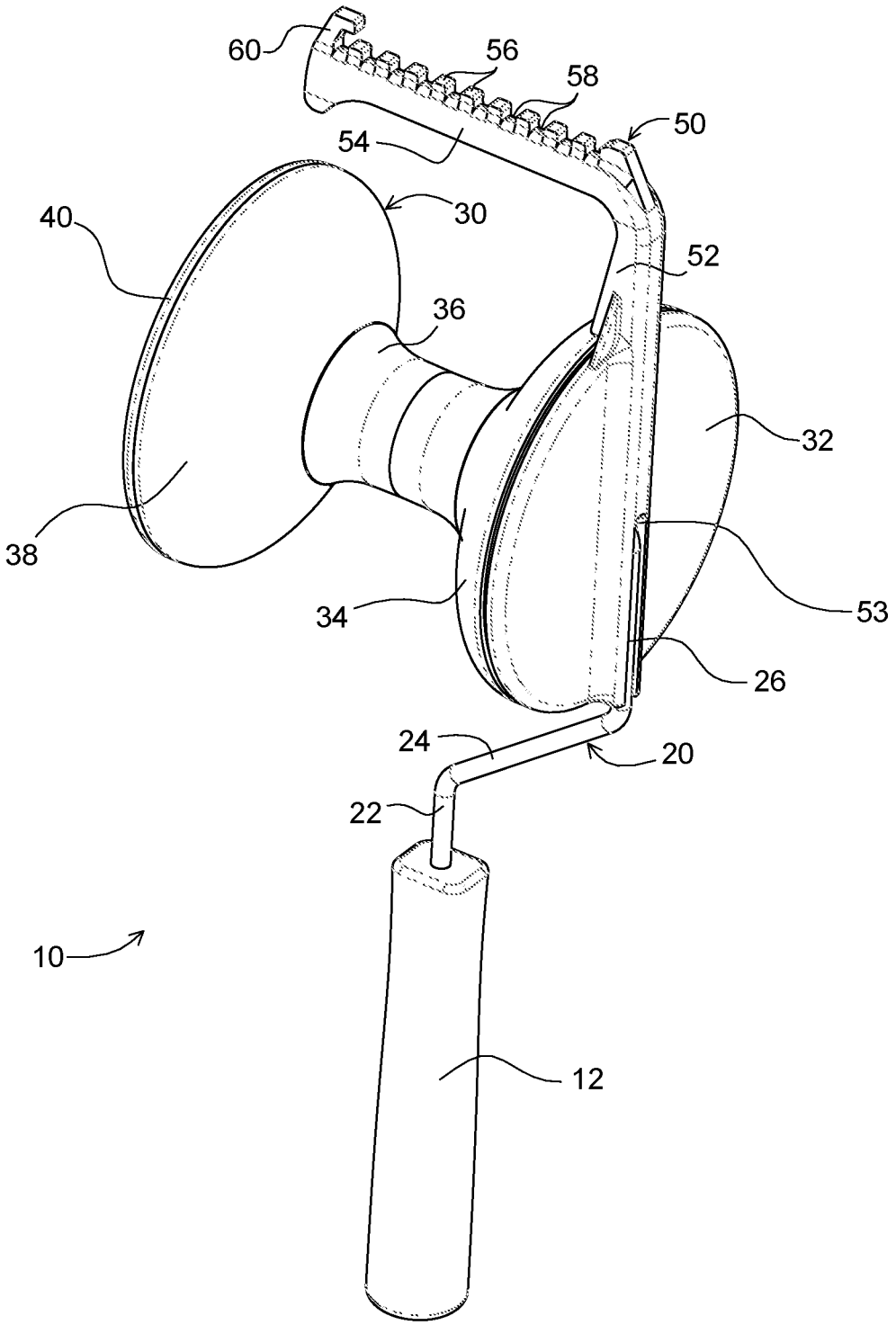
FIG. 1 is a front-top perspective view of a light roller device, according to an illustrative embodiment of the invention.
Figure 2:
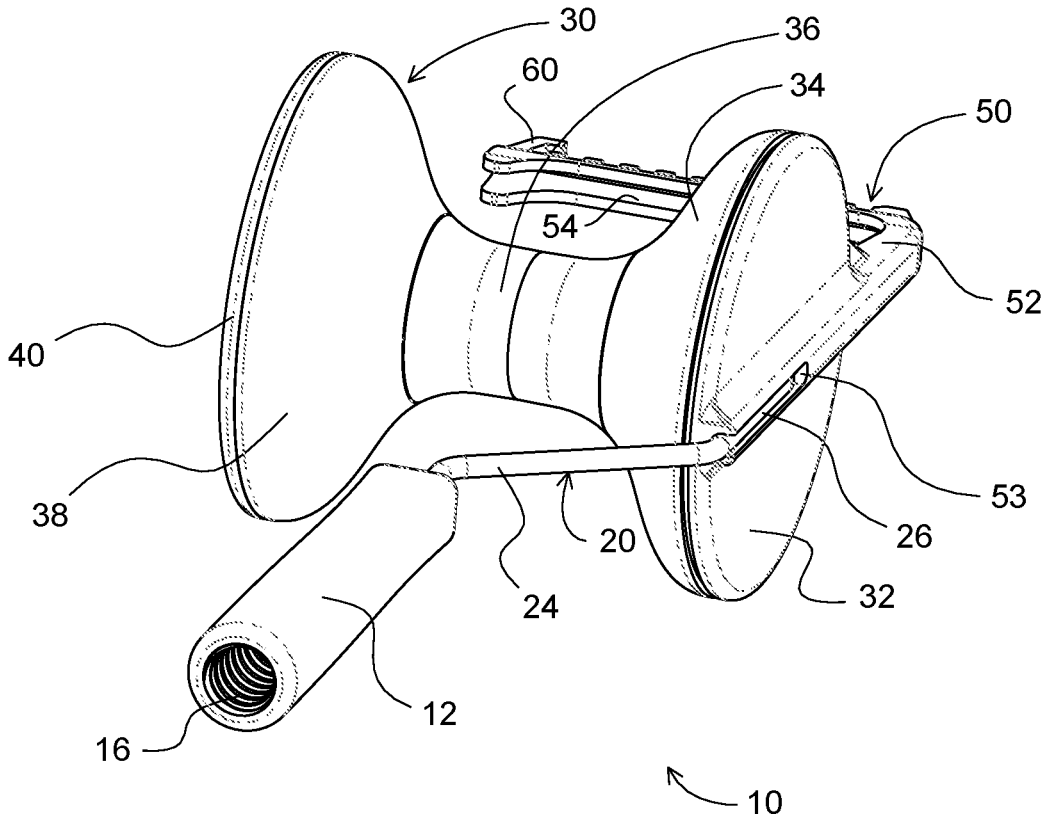
FIG. 2 is a bottom perspective view of the light roller device of FIG. 1.
Figure 10:
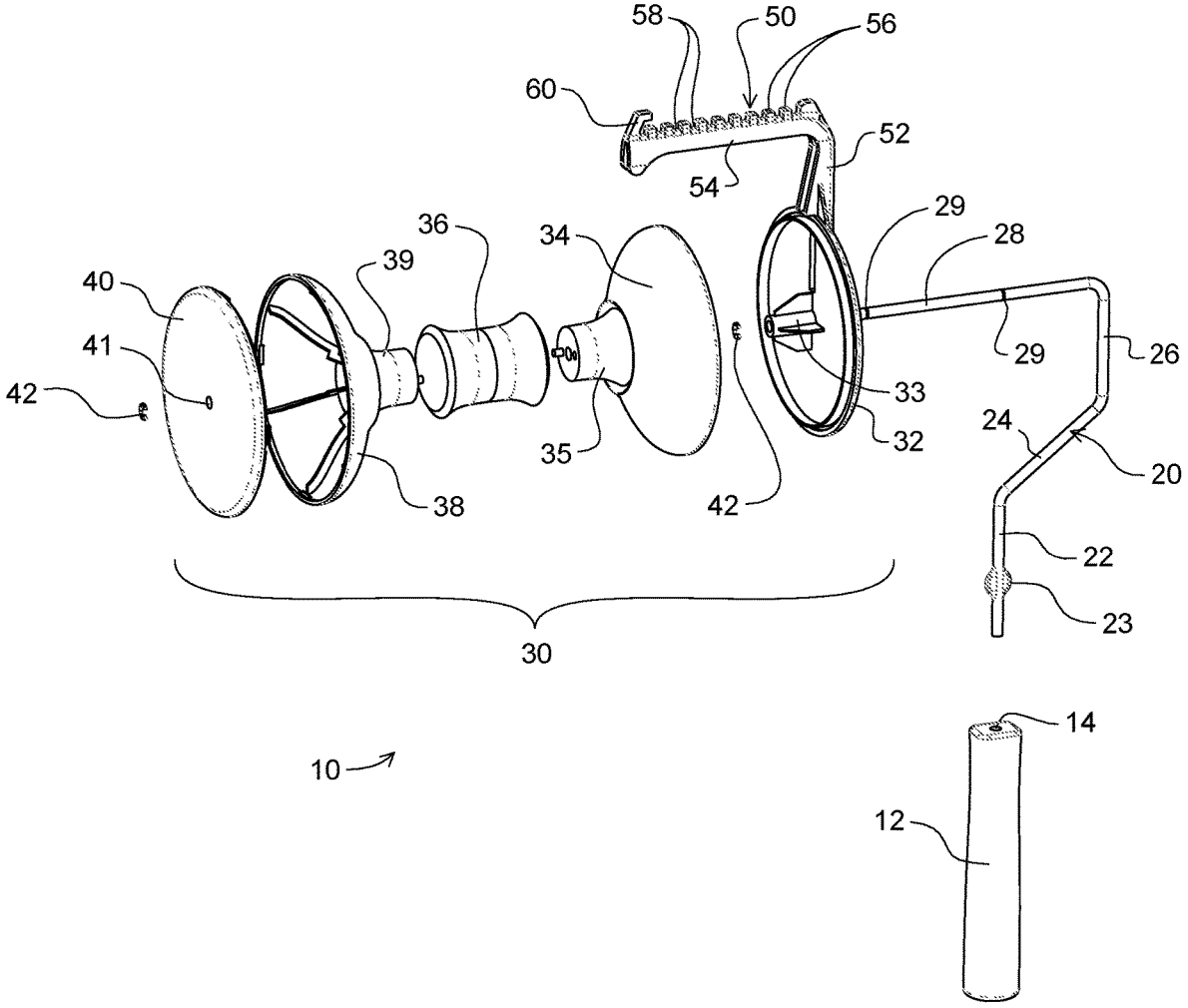
FIG. 10 is a first exploded perspective view of the light roller device of FIG. 1.
Figure 13:
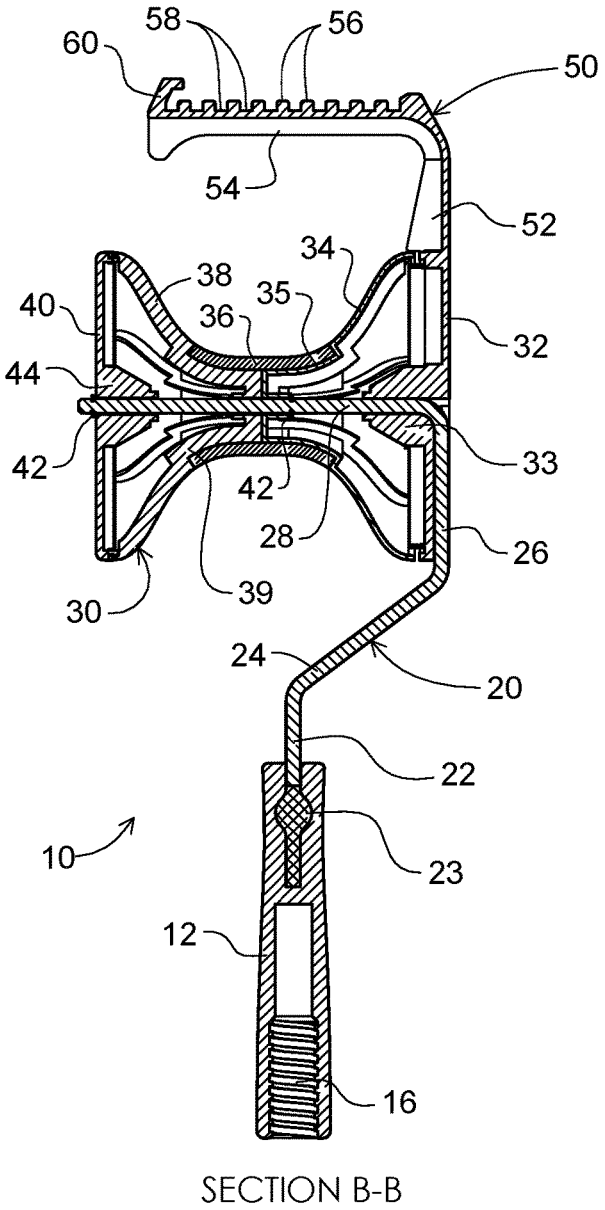
FIG. 13 is a longitudinal sectional view cut through the light roller device of FIG. 1, wherein the section is generally cut along the cutting-plane line B-B in FIG. 12.
Figure 14:
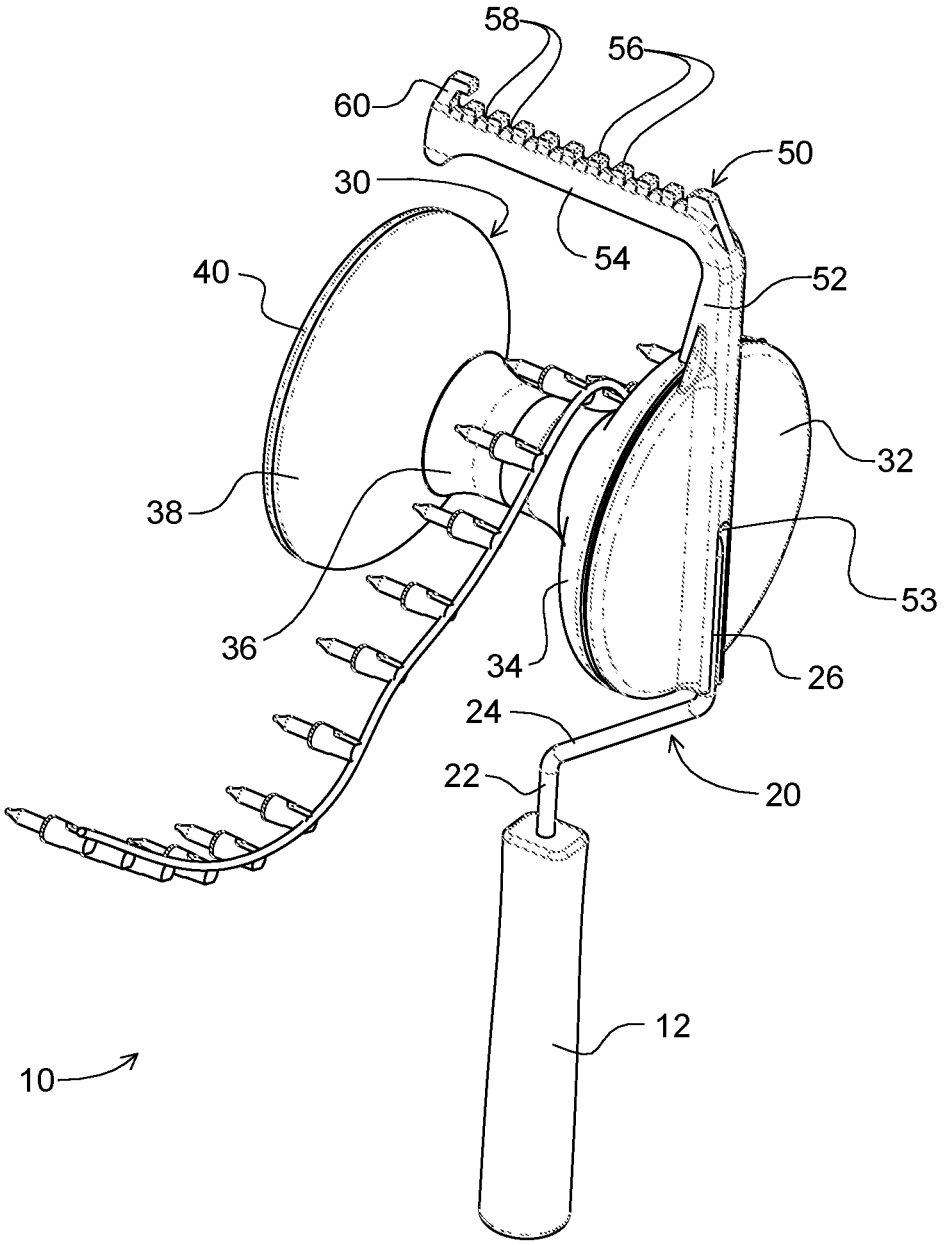
FIG. 14 is another front-top perspective view of the light roller device of FIG. 1, which illustrates the manner in which the roller member of the light roller device guides the wiring portion of the light strand.

In the illustrative embodiment, referring to FIGS. 1 and 10, it can be seen that the light roller device 10 further comprises a handle adapter 12 connected to a lower end of the support frame member 20. As best shown in FIGS. 2 and 13 of the illustrative embodiment, the handle adapter 12 comprises a plurality of internal threads 16 configured to threadingly engage with a plurality of external threads on an end of a pole member.

Figure 11:
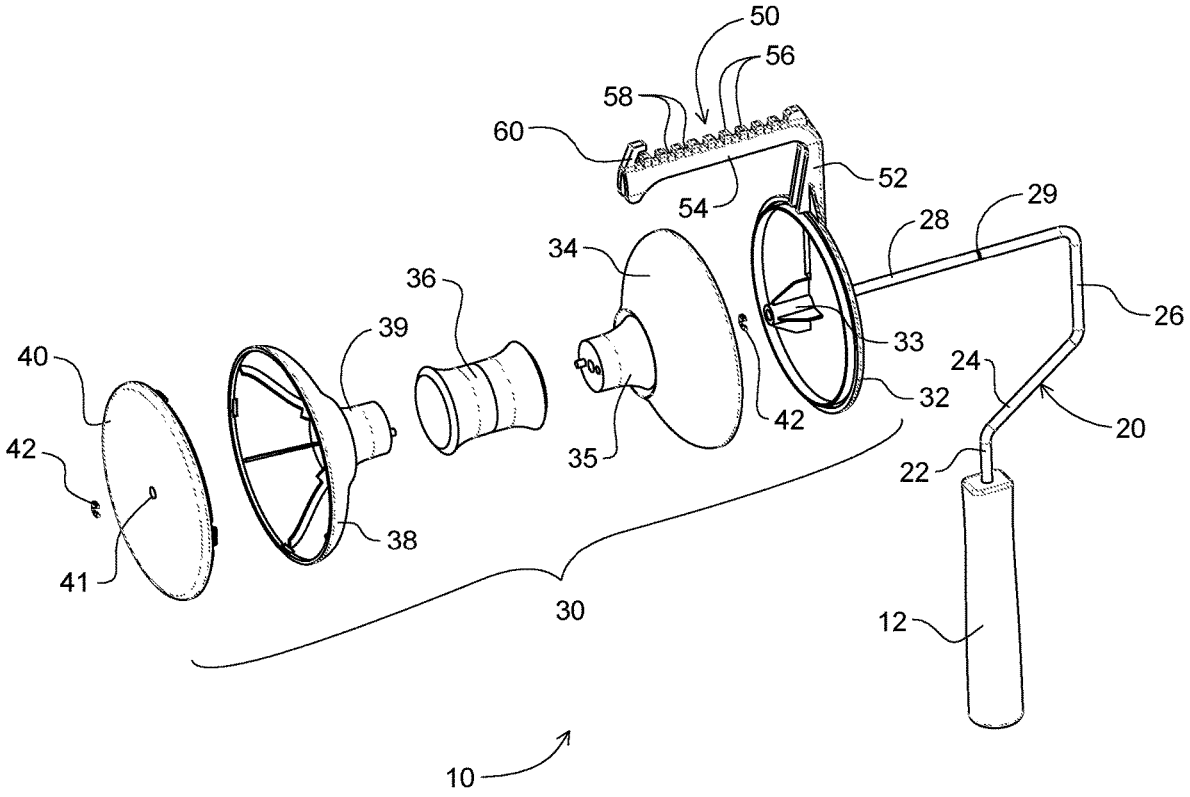
FIG. 11 is a second exploded perspective view of the light roller device of FIG. 1.

Now, with particular reference to FIGS. 1, 10, and 11, the roller assembly 30 of the illustrative light roller device 10 will be described. In the illustrative embodiment, as shown in FIGS. 1, 10, and 11, the roller member 34, 36, 38 of the roller assembly 30 further comprises a first tapered wall component 34, a second tapered wall component 38, and a center core component 36 coupling the first tapered wall component 34 to the second tapered wall component 38. In the illustrative embodiment, the center core component 36 is formed from a first material, and the first tapered wall component 34 and the second tapered wall component 38 are formed from a second material. The first material may be more compliant than the second material. Also, referring again to FIGS. 1, 10, and 11, it can be seen that, in the illustrative embodiment, the roller member 34, 36, 38 of the roller assembly 30 further comprises an end cap 40 coupled to an outer end of the second tapered wall component 38. In the illustrative embodiment, the end cap 40 increases a structural rigidity of the roller member 34, 36, 38, and the end cap 40 rotates with the roller member 34, 36, 38. As best shown in FIGS. 10 and 13, the end cap 40 is provided with a central gusseted boss portion 44 with a central aperture 41 disposed therethrough for accommodating a horizontal rod portion 28 of the bent rod-shaped member 20 described hereinafter.

The function of the roller end cap 40 in the illustrative embodiment is to "cap" the outer end of the roller member 34, 36, 38, which gives the roller member 34, 36, 38 more rigidity. In the illustrative embodiment, the end cap 40 snaps onto the end of the second tapered wall component 38 (see e.g., FIG. 13). The end cap 40 is configured to rotate around the horizontal rod portion 28 of the bent rod-shaped member 20, and the end cap 40 is held in place by retainer clip 42 described hereinafter. This retainer clip 42 acts as a thrust bearing preventing the roller member 34, 36, 38 from sliding on the horizontal rod portion 28 of the bent rod-shaped member 20. The retainer clips 42 keep the roller member 34, 36, 38 in a fixed location along the horizontal rod portion 28 of the bent rod-shaped member 20. In the illustrative embodiment, as described hereinafter, the retainer clips 42 snap into circumferential grooves or recesses 29 in the horizontal rod portion 28. As shown in FIGS. 10 and 13, the circumferential grooves or recesses 29 are located at spaced apart locations along the horizontal rod portion 28 (e.g., one circumferential groove or recess 29 is located outside the roller end cap 40 and the other circumferential groove or recess 29 is located inside a center boss portion 35 of the first tapered wall component 34.

In the illustrative embodiment, the first material forming the center core component 36 may be in a form of a soft flexible material. The first material forming the center core component 36 may be designed to have some frictional resistance so when the light string moves over the roller member 34, 36, 38, the roller member 34, 36, 38 rotates easily with the light string so that the two move simultaneously. In the illustrative embodiment, the soft surface of the first material interfaces with the delicate bulbs on the light string so the bulbs are not damaged or dislodged from their sockets as they move over the surface of the roller member 34, 36, 38.

In the illustrative embodiment, the outer surface of the first tapered wall component 34 comprises a smooth hard surface with minimal frictional resistance. This smooth surface along with the sloped angle and the help of gravity directs the string lights to the center region of the roller member 34, 36, 38. The center region of the roller member 34, 36, 38 with the center core component 36 is the optimal position for the light string. In this center region, the user can control the light string with less effort.

In the illustrative embodiment, similar to the first tapered wall component 34, the outer surface of second tapered wall component 38 comprises a smooth hard surface with minimal frictional resistance. This smooth surface along with the sloped angle and the help of gravity directs the string lights to the center region of the roller member 34, 36, 38. The center region of the roller member 34, 36, 38 with the center core component 36 is the optimal position for the light string. In this center region, the user can control the light string with less effort.

In the illustrative embodiment, the first material forming the center core component 36 may be soft, lightweight, durable, and be capable of maintaining its material characteristics in either cold or hot weather. For example, suitable materials that may be used for the first material include, but are not limited to, the following: (i) polypropylene foam, (ii) neoprene rubber, and (iii) silicon rubber. In the illustrative embodiment, the second material forming the first tapered wall component 34 and the second tapered wall component 38 may be durable, light, hard, rigid, and smooth. For example, suitable materials that may be used for the second material include, but are not limited to, the following: (i) high density polyethylene (HDPE), (ii) acrylic, (iii) fiberglass, (iv) aluminum, and (v) woven fiberglass fabric and epoxy resin.

Next, referring again to the illustrative embodiment of FIGS. 10, 11, and 13, the manner in which the center core component 36 couples the first tapered wall component 34 to the second tapered wall component 38 will be explained. As shown in FIGS. 10, 11, and 13, the first tapered wall component 34 comprises a center boss portion 35 and the second tapered wall component 38 comprises a center boss portion 39. In FIG. 13, it can be seen that the center core component 36 fits over the center boss portion 35 of the first tapered wall component 34 and the center boss portion 39 of the second tapered wall component 38 in a sleeve-like manner to join the components 34, 38 together so that the components 34, 36, 38 rotate together as one-piece when the roller member 34, 36, 38 rotates.

In the illustrative embodiment, with combined reference to FIGS. 1 and 10, it can be seen that the support frame member 20 of the light roller device 10 comprises a bent rod-shaped member. The bent rod-shaped member 20 comprises a first lower vertical rod portion 22, a diagonal rod portion 24, a second upper vertical rod portion 26, and a horizontal rod portion 28. In the illustrative embodiment, the horizontal rod portion 28 of the bent rod-shaped member 20 forms the portion of the support frame member about which the roller member 34, 36, 38 is rotatable so as to define a rotational axis of the roller member 34, 36, 38. As best shown in FIG. 10, the diagonal rod portion 24 is connected between the first lower vertical rod portion 22 and the second upper vertical rod portion 26, and the second upper vertical rod portion 26 is connected between the diagonal rod portion 24 and the horizontal rod portion 28. The diagonal rod portion 24 provides an offset in the support frame member 20 of the light roller device 10 such that the centerline of the handle adapter 12 is proximate to the center location of the roller member 34, 36, 38, thereby facilitating a manipulation of a light strand by the light roller device 10. In the illustrative embodiment, as shown in FIG. 1, the handle adapter 12 is connected to a lower end of the first lower vertical rod portion 22. Also, in the illustrative embodiment, the first lower vertical rod portion 22 is provided with opposed protrusions 23, which are configured to secure the first lower vertical rod portion 22 within the handle adapter 12 (refer to FIGS. 10 and 13). In addition, as shown in FIG. 10, the top of the handle adapter 12 is provided with a hole 14 formed therein for accommodating the first lower vertical rod portion 22 extending into the interior of the handle adapter 12.

In the illustrative embodiment, referring initially to FIG. 10, it can be seen that the horizontal rod portion 28 of the bent rod-shaped member 20 comprises a pair of annular clip recesses 29 formed in the horizontal rod portion 28. Each of the annular clip recesses 29 are configured to receive a respective retainer clip 42 for maintaining the roller member 34, 36, 38 in a fixed location along a length of the horizontal rod portion 28 (refer to FIGS. 3, 4, and 13).

In the illustrative embodiment, the bent rod-shaped support frame 20 acts as the support structure for all of the other components described above. In the illustrative embodiment, the support frame member 20 is in a shape of a bent cylindrical rod (refer to FIGS. 10 and 11). The bent rod-shaped support frame 20 could be made of many different materials, but a suitable material for the bent rod-shaped support frame 20 has good rigidity and strength (e.g., a frame 20 formed from a suitable metallic material, such as steel or aluminum). In the illustrative embodiment, the bent rod-shaped support frame 20 is one continuous piece that begins at the handle adapter 12 and ends at the outside edge of the roller end cap 40. As best shown in FIGS. 10 and 11, the bent rod-shaped member 20 is shaped into multiple angles and straight lengths. Once the bent rod-shaped member 20 has been fabricated into its desired shape, it is designed to maintain that shape for the life of the light roller device 10.

In the illustrative embodiment, as described above, the handle adapter 12 is connected to the first lower vertical rod portion 22 of the bent rod-shaped member 20. More specifically, with reference to the sectional view of FIG. 13, in the illustrative embodiment, the handle adapter 12 is molded solid around the first lower vertical rod portion 22 of the bent rod-shaped member 20 to hold it stationary. For example, as shown in FIG. 13, the opposed protrusions 23 are embedded in the interior portion of the handle adapter 12. In the illustrative embodiment, the handle adapter 12 acts as a handle for the light roller device 10. The handle adapter 12 is where the user can grasp and maneuver the light roller device 10. The handle adapter 12 is also designed to be an extension pole connector so as to allow the light roller device 10 to be connected to a pole in a secure, yet removable manner. More specifically, the handle adapter 12 functions as an internally threaded female connector that threadingly engages a male end portion of a pole with external threads. Advantageously, the added pole gives the user additional length to hang lights at a higher elevation. This added pole feature alleviates the need for ladders or scaffolding.

Figure 3:
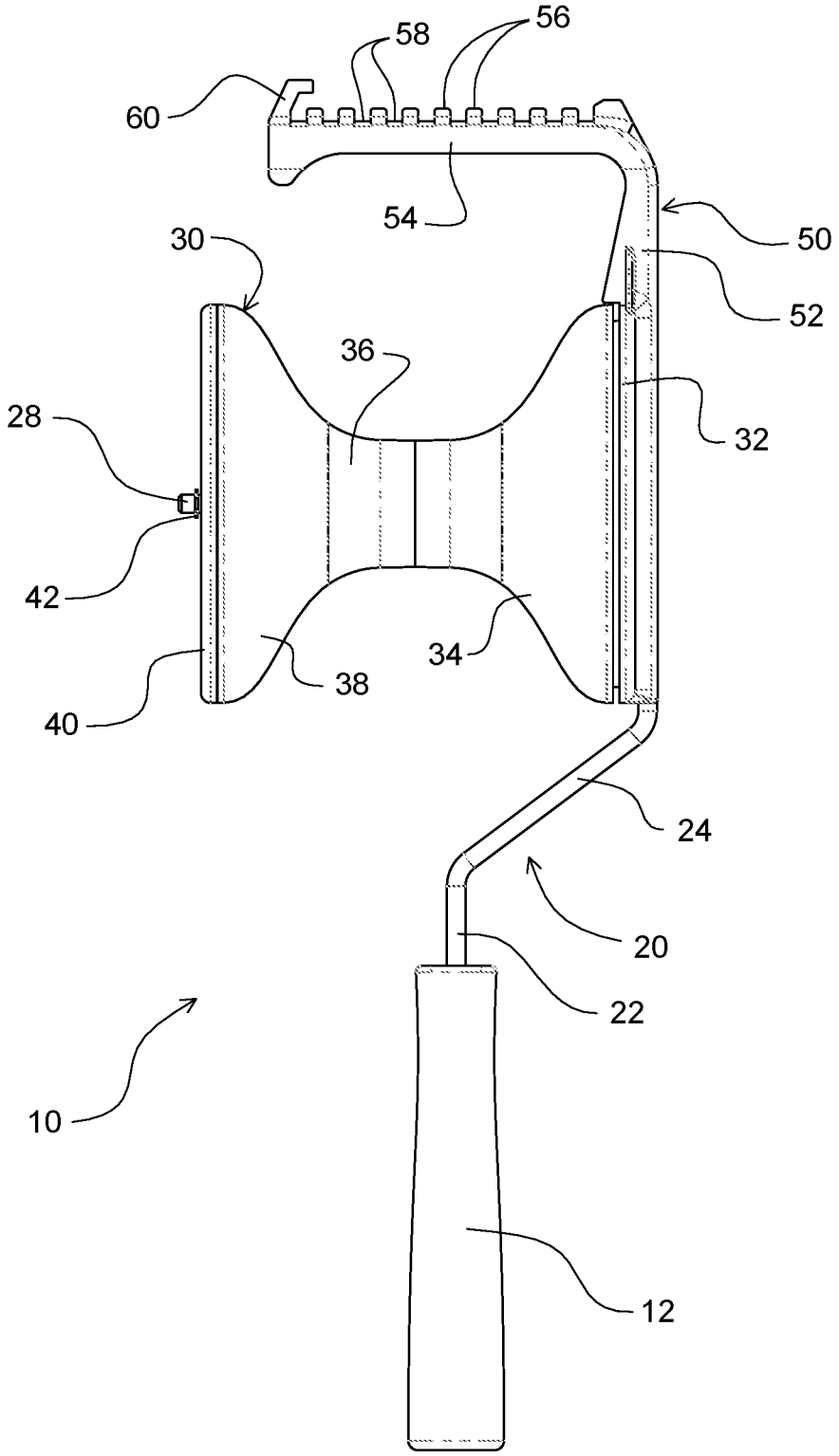
FIG. 3 is a front elevational view of the light roller device of FIG. 1.
Figure 4:
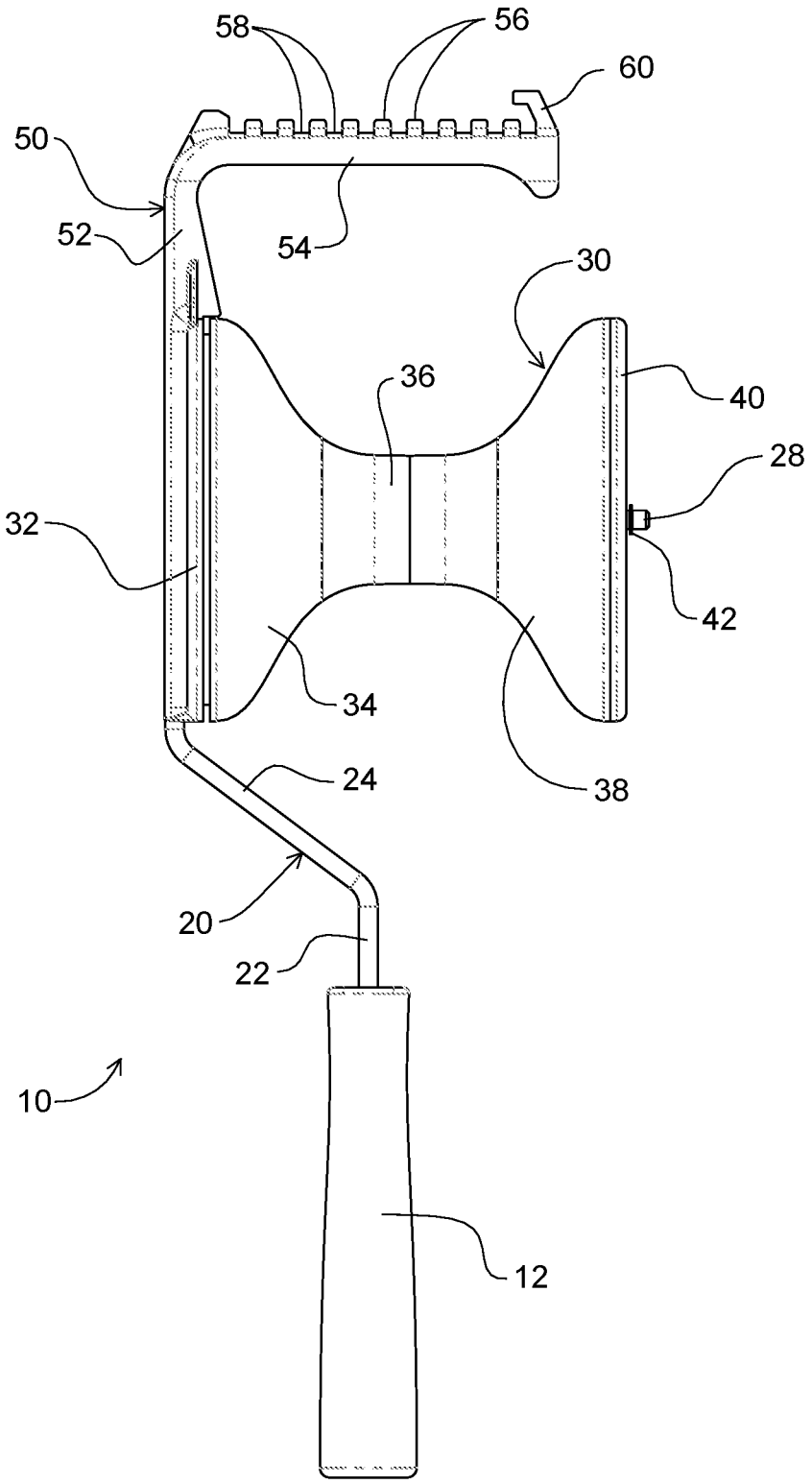
FIG. 4 is a rear elevational view of the light roller device of FIG. 1.

Referring again to FIGS. 1, 10, and 11, in the illustrative embodiment, the light roller device 10 further comprises a guide arm member 50 coupled to the support frame member 20. In the illustrative embodiment, the guide arm member 50 comprises a vertical arm portion 52 and a horizontal arm portion 54. In FIGS. 3 and 4, it can be seen that the horizontal arm portion 54 may be disposed at an angle of approximately 90 degrees or 90 degrees relative to the vertical arm portion 52. As best shown in FIGS. 1, 3, and 4, the horizontal arm portion 54 of the guide arm member 50 extends above a portion of the roller member 34, 36, 38. In the illustrative embodiment, the guide arm member 50 is configured to restrict a vertical movement of a wiring portion of a light strand so as to urge the wiring portion of the light strand towards the middle portion of the roller member 34, 36, 38 (see e.g., FIG. 14).

Figure 15:
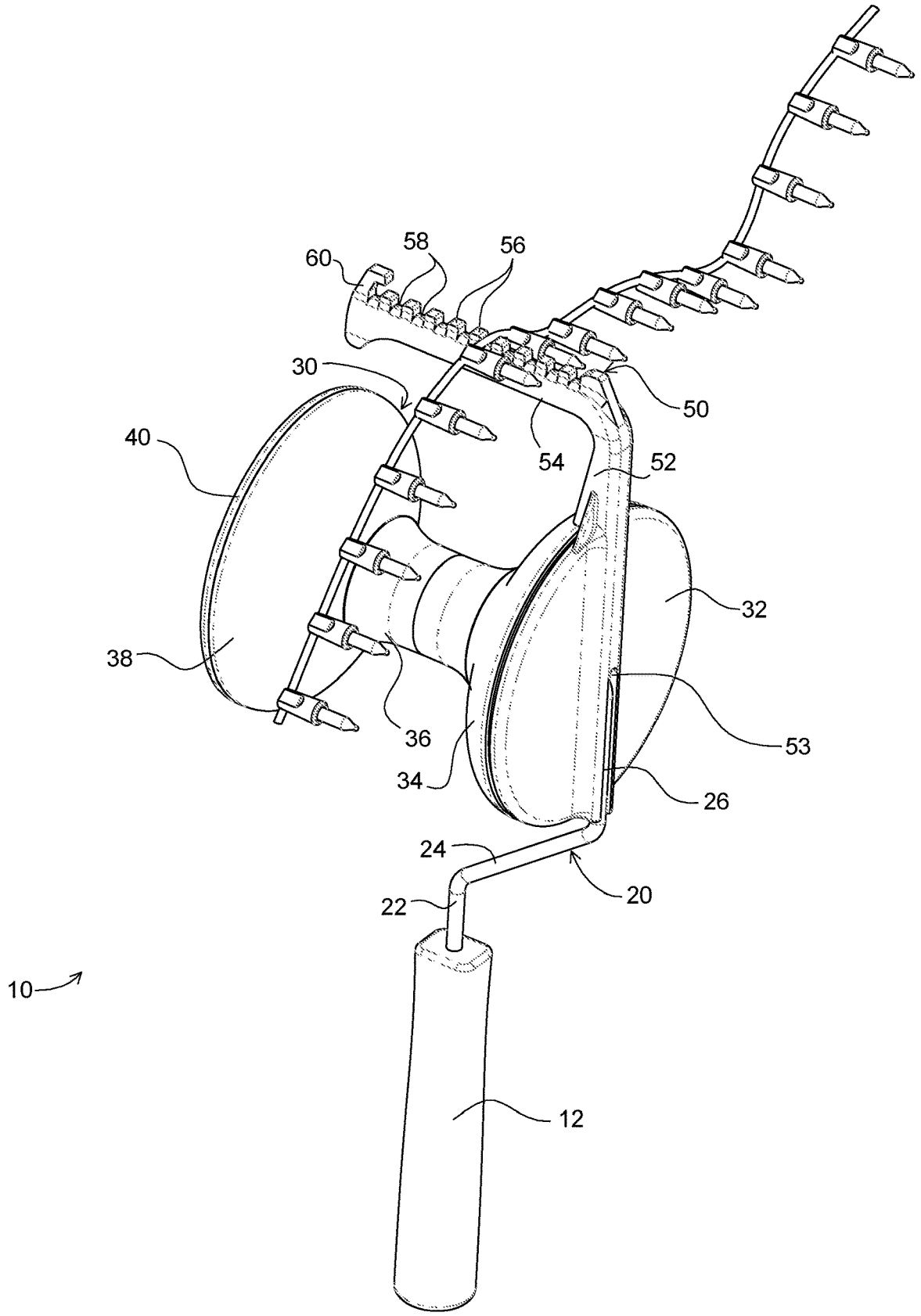
FIG. 15 is another front-top perspective view of the light roller device of FIG. 1, which illustrates the manner in which the guide arm member of the light roller device is used to manipulate the wiring portion of the light strand.

With reference again to FIGS. 1, 3, 4, 10, and 11, in the illustrative embodiment, the horizontal arm portion 54 of the guide arm member 50 comprises a plurality of spaced-apart protrusions 56 disposed along the length of an upper part of the horizontal arm portion 54. In the illustrative embodiment, individual ones of the plurality of spaced-apart protrusions 56 are spaced apart from one another by respective notches 58 (see FIGS. 1, 10, and 11). The plurality of spaced-apart protrusions 56 disposed along the length of the upper part of the horizontal arm portion 54 of the guide arm member 50 are configured to be used to manipulate a light strand after the light strand has been hung from the elevated object (refer to FIG. 15). In addition, referring again to the illustrative embodiment of FIGS. 1, 3, 4, 10, and 11, it can be seen that the horizontal arm portion 54 of the guide arm member 50 further comprises a hook member 60 disposed on an outer end of the horizontal arm portion 54 of the guide arm member 50. The hook member 60 defines a hook member gap (see FIGS. 3 and 4). The hook member 60 functions as a wire blocker to prevent a light strand from sliding off the outer end of the horizontal arm portion 54 of the guide arm member 50, and the hook member 60 is configured to prevent light bulbs on the light strand from being pulled through the hook member gap. In the illustrative embodiment, the hook member 60 also allows the light strand to be grasped and pulled using the guide arm member 50 when adjusting a position of a light strand.

In the illustrative embodiment, the hook member 60 may be used as a tool for pulling a light string from one support to another. The hook member 60 is designed so that a user can position the end of the light string, with his or her hands, into the hook area. The wire of the light strand can be placed into the hook area next to a light socket so the wire will not slide out of position. Once the light string is in position, the user can now pull the light string taut in a longitudinal direction with tension to the designated elevated support.

In the illustrative embodiment, turning again to FIGS. 1, 10, and 11, it can be seen that the light roller device 10 further comprises a cylindrical base component 32 being coupled to an outer end of the first tapered wall component 34 of the roller member 34, 36, 38. The cylindrical base component 32 forms an end cap for the first tapered wall component 34, and the cylindrical base component 32 couples the guide arm member 50 to the support frame member 20 (see FIG. 1). More specifically, as best shown in FIGS. 1, 2, 13, and 14, the cylindrical base component 32 comprises a longitudinal slot 53 formed in an outer surface of the cylindrical base component 32. The longitudinal slot 53 is configured to receive a substantial part of the second upper vertical rod portion 26 of the bent rod-shaped member 20 in the longitudinal slot 53 (refer to FIGS. 1, 13, and 14). As best shown in FIGS. 10, 11, and 13, similar to the end cap 40, the cylindrical base component 32 is provided with a central gusseted boss portion 33 with a central aperture disposed therethrough for accommodating the horizontal rod portion 28 of the bent rod-shaped member 20.

Figure 5:
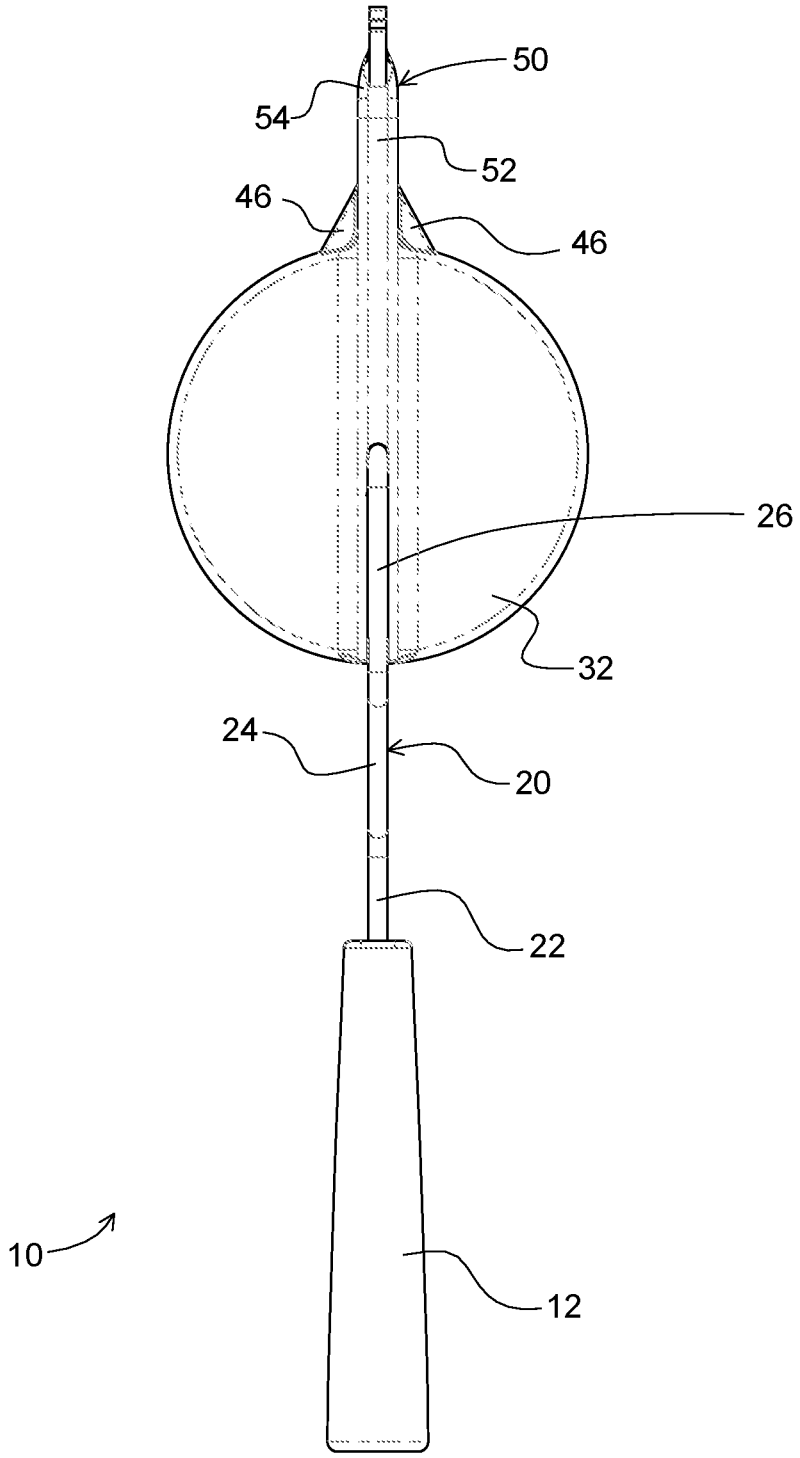
FIG. 5 is a first side elevational view of the light roller device of FIG. 1.
Figure 6:
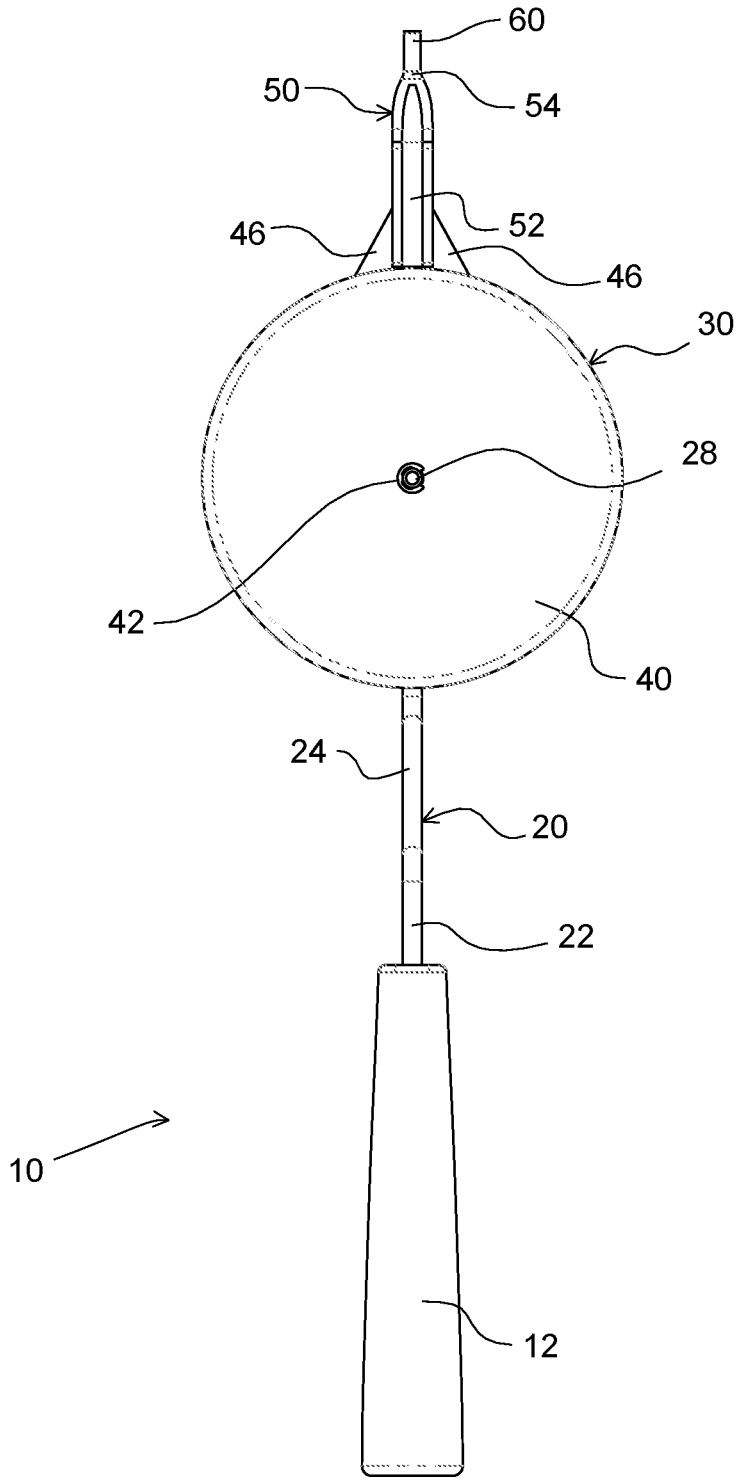
FIG. 6 is a second side elevational view of the light roller device of FIG. 1.
Figure 7:
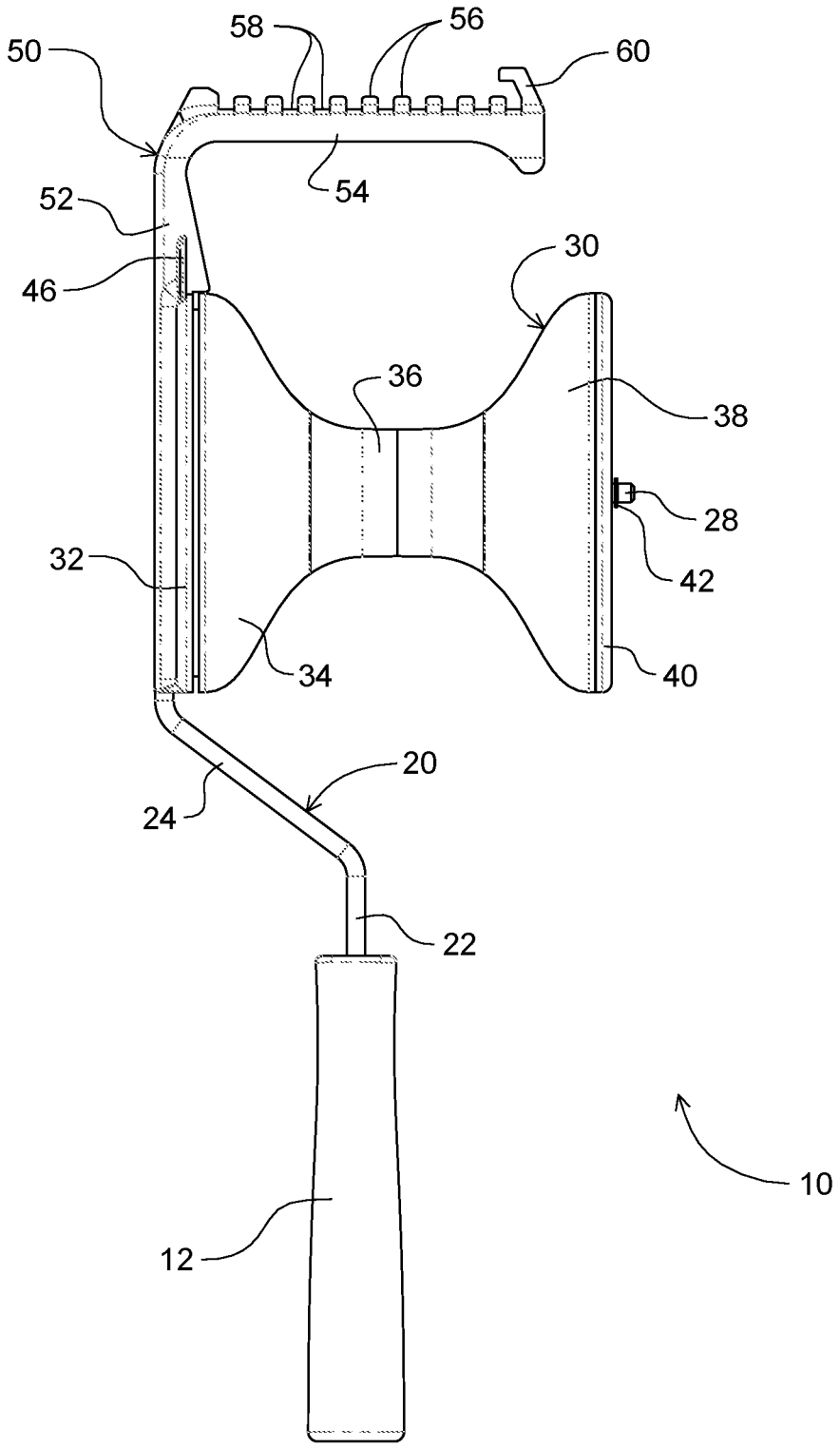
FIG. 7 is another rear elevational view of the light roller device of FIG. 1.
Figure 8:
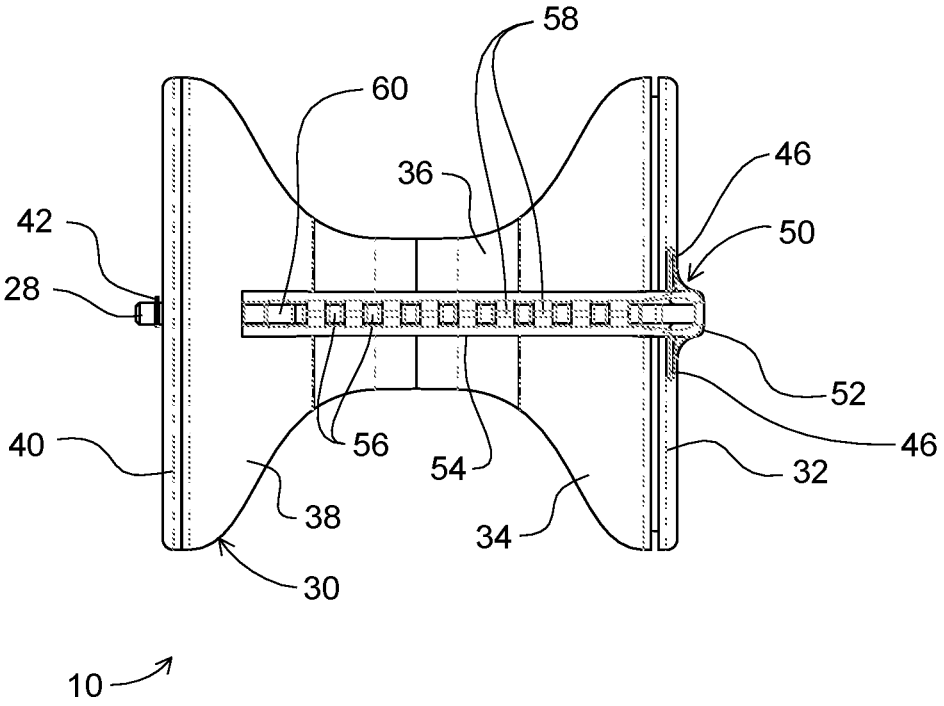
FIG. 8 is a top plan view of the light roller device of FIG. 1.
Figure 9:
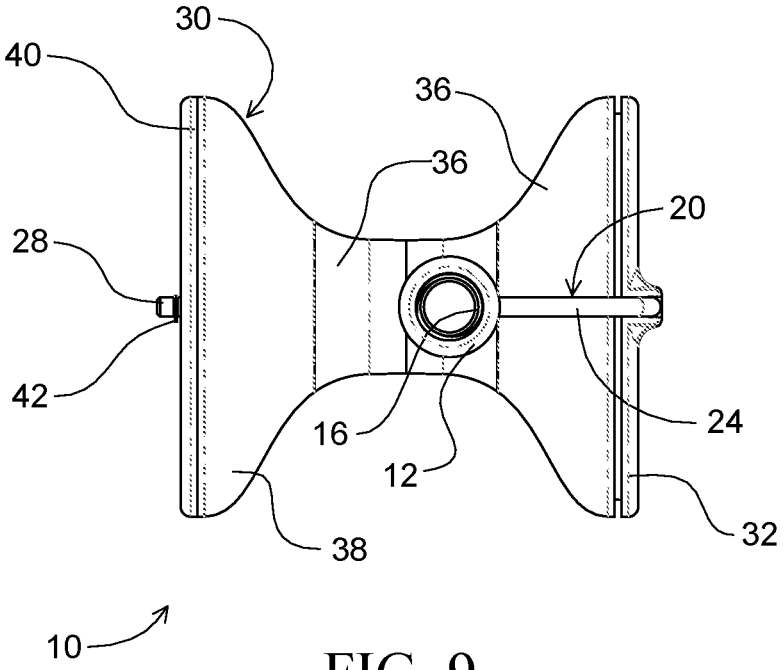
FIG. 9 is a bottom plan view of the light roller device of FIG. 1.
Figure 12:
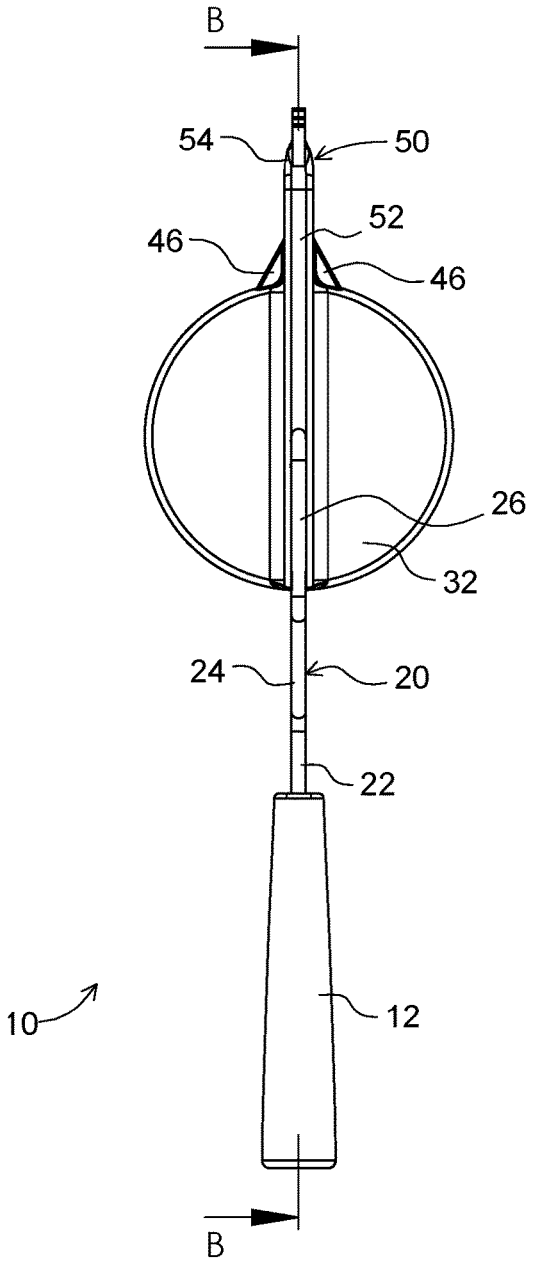
FIG. 12 is another first side elevational view of the light roller device of FIG. 1.

As shown in the illustrative embodiment of FIGS. 5-8 and 12, the light roller device 10 may further comprise a pair of angled gusset members 46 configured to prevent a wiring portion of a light strand from becoming wedged in a gap between the cylindrical base component 32 and the first tapered wall component 34 of the roller member 34, 36, 38. As best shown in FIGS. 5, 6, and 12, each of the angled gusset members 46 is connected between the cylindrical base component 32 and the vertical arm portion 52 of the guide arm member 50.

In the illustrative embodiment, the cylindrical base component 32 and the guide arm member 50 may be molded together as a single structure (see e.g., FIGS. 10 and 11). In the illustrative embodiment, the upper vertical rod portion 26 of the bent rod-shaped member 20 is attached to the cylindrical base component 32 by a slotted press fit in longitudinal slot 53. The cylindrical base component 32 acts as a guide for the roller member 34, 36, 38. The roller member 34, 36, 38 rotates within and relative to the cylindrical base component 32. The cylindrical base component 32 and the guide arm member 50 do not rotate, but rather are held stationary with the bent rod-shaped support frame 20.

In the illustrative embodiment, the guide arm member 50 is an integral part of the cylindrical base component 32, and is located on the top of the cylindrical base component 32. As described above, the horizontal arm portion 54 of the guide arm member 50 is positioned above the roller member 34, 36, 38 and the center of the roller member 34, 36, 38. In the illustrative embodiment, the horizontal arm portion 54 of the guide arm member 50 acts as a ceiling to maintain the position of the string lights in the center region of the roller member 34, 36, 38. In the illustrative embodiment, while the horizontal arm portion 54 of the guide arm member 50 does not extend the full length of the roller member 34, 36, 38, it is to be understood that, in other embodiments, the horizontal arm portion 54 may extend the full length of the roller member 34, 36, 38 or beyond the full length of the roller member 34, 36, 38. As described above, the horizontal arm portion 54 of the guide arm member 50 has alternating protrusions/notches 56, 58 on the top part of the horizontal arm portion 54. The alternating protrusions/notches 56, 58 act as a tool. The protrusions or ridges 56 are primarily used to manipulate the light string after the lights have been hung. For example, a portion of the light string wire fits into one or more of the guide arm notches 58 so that the wire can be lifted and maneuvered into another position.

It is readily apparent that the illustrative light roller device 10 offers numerous advantages. First, the light roller device 10 facilitates the hanging of lights on trees and other elevated structures in a safe manner. Additionally, this device 10 allows a person to safely hang the lights high without the use of ladders or other equipment. The soft roller design of the illustrative embodiment helps to eliminate damage to the string lights. The guide arm member 50 of the illustrative embodiment makes adjusting the string lights easy to perform after they have been hung. In addition, the light roller device 10 also makes taking down the lights safer, easier and faster.

Advantageously, the aforedescribed light roller device 10 is a multipurpose tool. The light roller device 10 utilizes a tapered roller member 34, 36, 38 to hang string lights onto tree limbs or other structures. In one or more embodiments, the handle adapter 12 of the light roller device 10 is mounted on a distal end of a pole (e.g., a telescoping pole) in order to reach elevated locations for hanging lights. In the illustrative embodiment, the roller member 34, 36, 38 of the light roller device 10 is tapered to the center of the roller assembly 30. This tapering helps cradle the string lights into the middle portion of the roller member (i.e., with center core component 36).

In the illustrative embodiment, the string lights are hung onto tree limbs or structures by using the roller member 34, 36, 38 with soft center core component 36 to feed the string lights as they are supported from one point to the next. The tapered roller member 34, 36, 38 rotates as the lights are being placed. The tapered roller member 34, 36, 38 provides constant feed until all the lights have been hung in order to make the task of hanging light strings much easier and safer.

In the illustrative embodiment, the light roller device 10 further includes the guide arm member 50. As described above, the guide arm member 50 has a couple of functions. First, the guide arm member 50 helps to keep the light string engaged in the middle portion of the roller member (i.e., with center core component 36) during the hanging process. Secondly, the guide arm member 50 works as a secondary tool to adjust the lighting after the string lights have been hung. This is done using the spaced-apart protrusions 56 on the horizontal arm portion 54 to help pick up the string lights and manipulate them.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A light roller device, comprising:

a support frame member;

a roller assembly coupled to the support frame member, the roller assembly including a roller member that is rotatable about a portion of the support frame member, the roller member configured to guide and support a wiring portion of a light strand as the light strand is being hung from an elevated object, and the roller member being inwardly tapered toward a middle portion of the roller member for guiding the wiring portion of the light strand to the middle portion of the roller member as the light strand is being hung from the elevated object; and a guide arm member coupled to the support frame member, the guide arm member extending above at least a portion of the roller member, the guide arm member configured to restrict a vertical movement of the wiring portion of the light strand so as to urge the wiring portion of the light strand towards the middle portion of the roller member.

2. The light roller device according to claim 1, wherein the roller member of the roller assembly further comprises a first tapered wall component, a second tapered wall component, and a center core component coupling the first tapered wall component to the second tapered wall component, the center core component being formed from a first material, and the first tapered wall component and the second tapered wall component being formed from a second material, the first material being softer than the second material.

3. The light roller device according to claim 2, wherein the roller member of the roller assembly further comprises at least one end cap, the at least one end cap being coupled to an outer end of one of the first tapered wall component and the second tapered wall component, and the at least one end cap increasing a structural rigidity of the roller member.

4. The light roller device according to claim 1, wherein the support frame member comprises a bent rod-shaped member, the bent rod-shaped member comprises at least one a vertical rod portion and a horizontal rod portion, the horizontal rod portion of the bent rod-shaped member forming the portion of the support frame member about which the roller member is rotatable so as to define a rotational axis of the roller member.

5. The light roller device according to claim 4, wherein the bent rod-shaped member further comprises a diagonal rod portion, and the at least one vertical rod portion comprises a first lower vertical rod portion and a second upper vertical rod portion, the diagonal rod portion being connected between the first lower vertical rod portion and the second upper vertical rod portion, and the second upper vertical rod portion being connected between the diagonal rod portion and the horizontal rod portion.

6. The light roller device according to claim 5, further comprising a handle adapter connected to a lower end of the first lower vertical rod portion, the handle adapter comprising a plurality of internal threads configured to threadingly engage with a plurality of external threads on an end of a pole member.

7. The light roller device according to claim 1, wherein the guide arm member further comprises a plurality of spaced-apart protrusions disposed along an upper portion of the guide arm member, individual ones of the plurality of spaced-apart protrusions being spaced apart from one another by respective notches, the plurality of spaced-apart protrusions disposed along the upper portion of the guide arm member being configured to be used to manipulate the light strand after the light strand has been hung from the elevated object.

8. The light roller device according to claim 1, wherein the guide arm member further comprises a hook member disposed on an outer end of the guide arm member, the hook member defining a hook member gap, the hook member configured to prevent the light strand from sliding off the outer end of the guide arm member, and the hook member configured to prevent light bulbs on the light strand from being pulled through the hook member gap.

9. The light roller device according to claim 1, further comprising a cylindrical base component being coupled to an outer end of a first tapered wall component of the roller member, the cylindrical base component forming an end cap for the first tapered wall component.

10. The light roller device according to claim 9, wherein the support frame member comprises a bent rod-shaped member, the bent rod-shaped member comprises at least one vertical rod portion and a horizontal rod portion, the horizontal rod portion of the bent rod-shaped member forming the portion of the support frame member about which the roller member is rotatable so as to define a rotational axis of the roller member.

11. The light roller device according to claim 10, wherein the horizontal rod portion of the bent rod-shaped member comprises at least one annular clip recess formed in the horizontal rod portion, the at least one annular clip recess configured to receive a retainer clip for maintaining the roller member in a fixed location along a length of the horizontal rod portion.

12. The light roller device according to claim 10, wherein the at least one vertical rod portion of the bent rod-shaped member comprises a first lower vertical rod portion and a second upper vertical rod portion, and the light roller device further comprises a longitudinal slot configured to receive at least a part of the second upper vertical rod portion of the bent rod-shaped member in the longitudinal slot.

13. The light roller device according to claim 9, further comprising an angled gusset member connected between the cylindrical base component and the guide arm member, the angled gusset member configured to prevent the wiring portion of the light strand from becoming wedged in a gap between the cylindrical base component and the first tapered wall component of the roller member.

14. The light roller device according to claim 1, further comprising a handle adapter connected to a lower end of the support frame member, the handle adapter comprising a plurality of internal threads configured to threadingly engage with a plurality of external threads on an end of a pole member.

15. A light roller device, comprising:

a support frame member;

a roller assembly coupled to the support frame member, the roller assembly including a roller member that is rotatable about a portion of the support frame member, the roller member configured to guide and support a wiring portion of a light strand as the light strand is being hung from an elevated object, and the roller member being inwardly tapered toward a middle portion of the roller member for guiding the wiring portion of the light strand to the middle portion of the roller member as the light strand is being hung from the elevated object; and wherein the support frame member comprises a bent rod-shaped member, the bent rod-shaped member comprises at least one vertical rod portion and a horizontal rod portion, the horizontal rod portion of the bent rod-shaped member forming the portion of the support frame member about which the roller member is rotatable so as to define a rotational axis of the roller member.

16. The light roller device according to claim 15, further comprising a guide arm member coupled to the support frame member, the guide arm member extending above at least a portion of the roller member, the guide arm member configured to restrict a vertical movement of the wiring portion of the light strand so as to urge the wiring portion of the light strand towards the middle portion of the roller member.

17. The light roller device according to claim 16, wherein the guide arm member further comprises a plurality of spaced-apart protrusions disposed along an upper portion of the guide arm member, individual ones of the plurality of spaced-apart protrusions being spaced apart from one another by respective notches, the plurality of spaced-apart protrusions disposed along the upper portion of the guide arm member being configured to be used to manipulate the light strand after the light strand has been hung from the elevated object.

18. The light roller device according to claim 16, wherein the guide arm member further comprises a hook member disposed on an outer end of the guide arm member, the hook member defining a hook member gap, the hook member configured to prevent the light strand from sliding off the outer end of the guide arm member, and the hook member configured to prevent light bulbs on the light strand from being pulled through the hook member gap.

19. A light roller device, comprising:

a support frame member;

a roller assembly coupled to the support frame member, the roller assembly including a roller member that is rotatable about a portion of the support frame member, the roller member configured to guide and support a wiring portion of a light strand as the light strand is being hung from an elevated object, and the roller member being inwardly tapered toward a middle portion of the roller member for guiding the wiring portion of the light strand to the middle portion of the roller member as the light strand is being hung from the elevated object; and wherein the roller member of the roller assembly further comprises a first tapered wall component, a second tapered wall component, and a center core component coupling the first tapered wall component to the second tapered wall component, the center core component being formed from a first material, and the first tapered wall component and the second tapered wall component being formed from a second material, the first material being softer than the second material.

* * * * *